US007407405B1

(12) United States Patent
Slenczka

(10) Patent No.: US 7,407,405 B1
(45) Date of Patent: Aug. 5, 2008

(54) PLUG CONNECTION DEVICE

(76) Inventor: Thomas J. Slenczka, N. 9586 County Rd. F F, Hixton, WI (US) 54635

( * ) Notice: Subject to any disclaimer, the term of this patent is extended or adjusted under 35 U.S.C. 154(b) by 0 days.

(21) Appl. No.: 11/538,011

(22) Filed: Oct. 2, 2006

(51) Int. Cl.
*H01R 13/62* (2006.01)

(52) U.S. Cl. ..... 439/369

(58) Field of Classification Search ..... 439/369, 439/469, 364, 366–372, 345, 350, 357, 358, 439/314, 501, 449, 451, 894
See application file for complete search history.

(56) References Cited

U.S. PATENT DOCUMENTS

| | | | | |
|---|---|---|---|---|
| 2,406,567 A | * | 8/1946 | Schueneman | 439/369 |
| 2,903,669 A | * | 9/1959 | Gilman et al. | 439/369 |
| 3,609,638 A | | 9/1971 | Darrey | |
| 3,999,838 A | | 12/1976 | Howell | |
| 4,145,105 A | | 3/1979 | Dobson | |
| 4,221,449 A | | 9/1980 | Shugart, Jr. | |
| 4,875,874 A | * | 10/1989 | Windsor, Jr. | 439/369 |
| 4,940,424 A | * | 7/1990 | Odbert | 439/369 |
| 4,957,450 A | * | 9/1990 | Pioszak | 439/369 |
| 5,328,384 A | | 7/1994 | Magnuson | |
| D413,864 S | | 9/1999 | Kovacik et al. | |

* cited by examiner

*Primary Examiner*—Edwin A. León

(57) ABSTRACT

A plug connection device that provides an extra attachment means for two plugs when the two plugs are connected to one another. The device is fabricated from two components, which are a male grip and a female grip. The male grip is designed to be attached to a male plug assembly, while the female grip is designed to be attached to the female plug assembly. When the male plug assembly and the female plug assembly are removably attached to one another, the male grip and the female grip are also designed to be removably attached to one another, thereby making it more difficult for the male plug assembly and the female plug assembly to be disconnected from one another unless that is an individual's actual intent.

1 Claim, 3 Drawing Sheets

PLUG CONNECTION DEVICE

BACKGROUND OF THE INVENTION

The present invention concerns that of a new and improved plug connection device that provides an extra attachment means for two plugs when the two plugs are connected to one another.

DESCRIPTION OF THE PRIOR ART

U.S. Pat. No. 4,145,105, issued to Dobson, discloses a device for preventing the accidental disconnection of electrical cords, with the device comprising a first section and a second section.

U.S. Pat. No. 3,609,638, issued to Darrey, discloses an extension cord clamp assembly for detachable securing the ends of extension cords or cables together to prevent accidental disconnection of the plug and socket.

U.S. Pat. No. 5,328,384, issued to Magnuson, discloses an apparatus for detachably holding the ends of two cords together that has a first retaining rod and a first cord retaining hook on one end of the first retaining rod.

U.S. Pat. No. 4,221,449, issued to Shugart, Jr., discloses a locking device for maintaining two electrical cords in firm contact with each other.

U.S. Pat. No. 3,999,828, issued to Howell, discloses an accessory for bridging the connection between two electrical conductor cords.

U.S. Pat. No. D413,864, issued to Kovacik et al., discloses an ornamental design for a plug lock device.

SUMMARY OF THE INVENTION

The present invention concerns that of a new and improved plug connection device that provides an extra attachment means for two plugs when the two plugs are connected to one another. The device is fabricated from two components, which are a male grip and a female grip. The male grip is designed to be attached to a male plug assembly, while the female grip is designed to be attached to the female plug assembly. When the male plug assembly and the female plug assembly are removably attached to one another, the male grip and the female grip are also designed to be removably attached to one another, thereby making it more difficult for the male plug assembly and the female plug assembly to be disconnected from one another unless that is an individual's actual intent.

There has thus been outlined, rather broadly, the more important features of a plug connection device that the detailed description thereof that follows may be better understood and in order that the present contribution to the art may be better appreciated. There are, of course, additional features of the plug connection device that will be described hereinafter and which will form the subject matter of the claims appended hereto.

In this respect, before explaining at least one embodiment of the plug connection device in detail, it is to be understood that the plug connection device is not limited in its application to the details of construction and to the arrangements of the components set forth in the following description or illustrated in the drawings. The plug connection device is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present plug connection device. It is important, therefore, that the claims be regarded as including such equivalent constructions insofar as they do not depart from the spirit and scope of the present invention.

It is therefore an object of the present invention to provide a plug connection device which has all of the advantages of the prior art and none of the disadvantages.

It is another object of the present invention to provide a plug connection device which may be easily and efficiently manufactured and marketed.

It is another object of the present invention to provide a plug connection device which is of durable and reliable construction.

It is yet another object of the present invention to provide a plug connection device which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
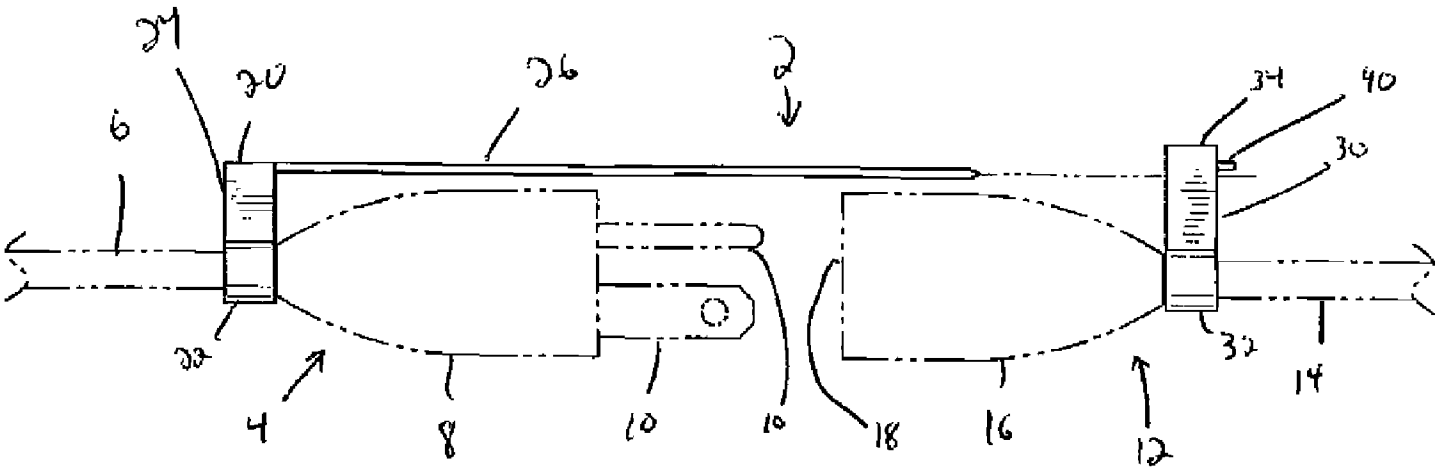
FIG. 1 shows a perspective view of the plug connection device as the male plug assembly and the female plug assembly are about to be connected to one another.
Figure 2:
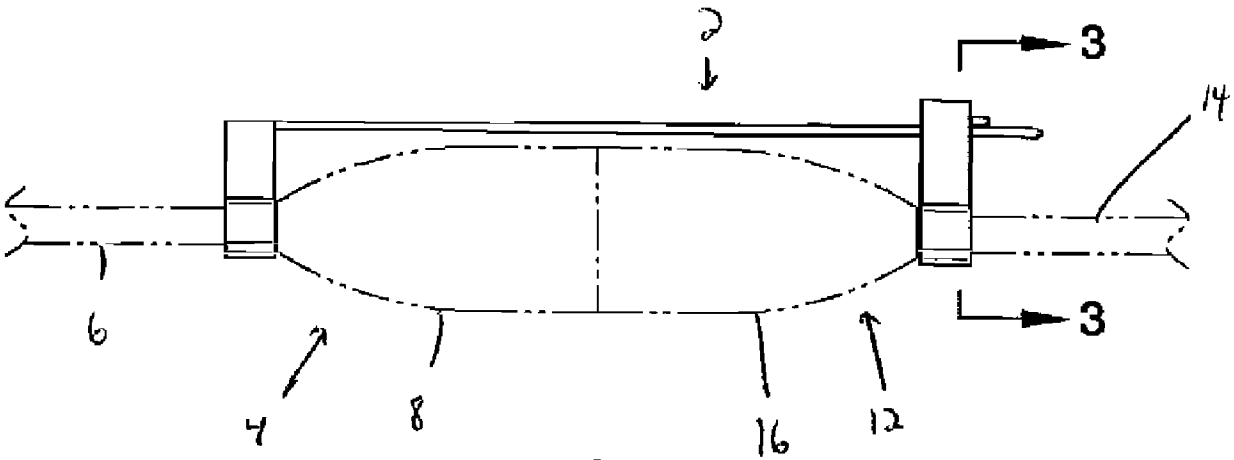
FIG. 2 shows a perspective view of the plug connection device after the male plug assembly and the female plug assembly have been connected to one another.
Figure 4:
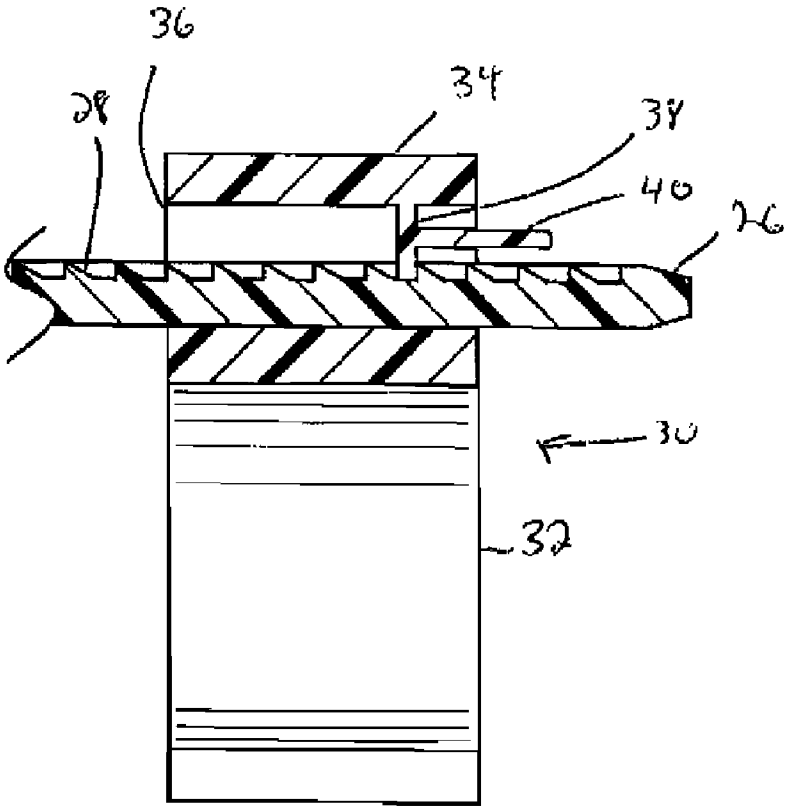
FIG. 4 shows a side cutaway view of the female grip after the locking strap of the male grip has been inserted through the insert on the female grip.
Figure 3:
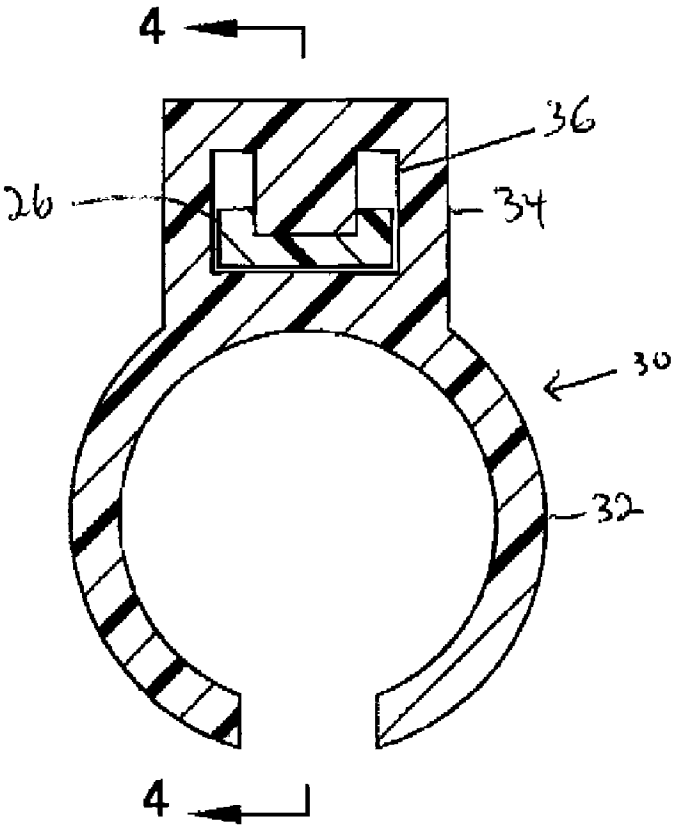
FIG. 3 shows an end cutaway view of the female grip after the locking strap of the male grip has been inserted through the insert on the female grip.
Figure 5:
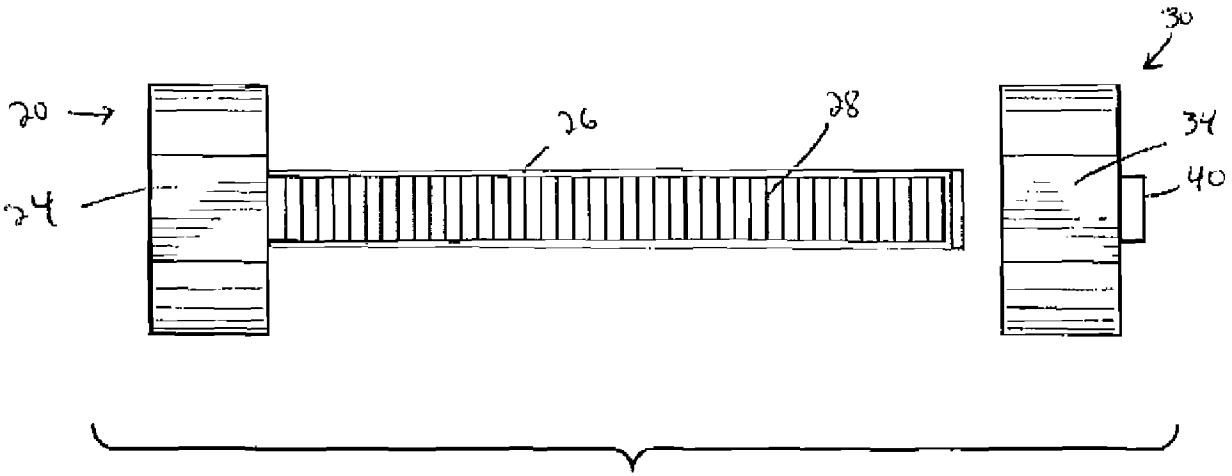
FIG. 5 shows a top view of the female grip and the male grip as the locking strap of the male grip is about to be inserted through the insert on the female grip.
Figure 6:
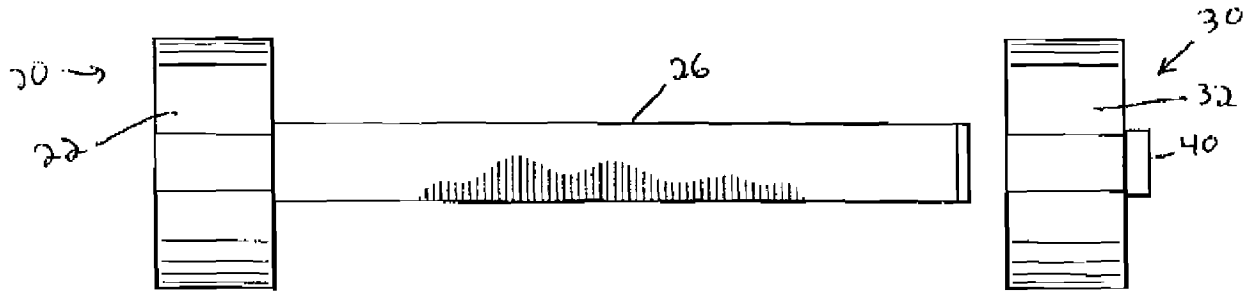
FIG. 6 shows a top view of the female grip and the male grip as the locking strap of the male grip is about to be inserted through the insert on the female grip.

With reference now to the drawings, and in particular to FIGS. 1 through 6 thereof, a new plug connection device embodying the principles and concepts of the present invention and generally designated by the reference numeral 2 will be described.

As best illustrated in FIGS. 1 through 6, the plug connection device 2 comprises two primary components, which are a male grip 20 and a female grip 30. The male grip 20 is associated with a male plug assembly 4, while the female grip 30 is associated with a female plug assembly 12. Both the male plug assembly 4 and the female plug assembly are not really part of the present invention, but are integrally attached to the plug connection device 2 and therefore will be discussed with some detail.

The male plug assembly 4 comprises an electrical cord 6 and a head 8 that is attached to the electrical cord 6. A plurality of prongs 10 are attached to the head. The female plug assembly 12 comprises an electrical cord 14 and a head 16 that is attached to the electrical cord 14. A plurality of holes 18 are attached to the head 16. Generally, when an individual wants to connect the male plug assembly 4 to the female plug assembly 12, he or she can insert each of the prongs 10 of the plurality of prongs 10 into a hole 18 of the plurality of holes 18.

The device 2 provides additional protection once the male plug assembly 4 and the female plug assembly 12 have been attached to one another to ensure that they will remain attached until deliberately pulled apart by an individual. The male grip 20 comprises a clamp 22 which is attached to the cord 6 of the male plug assembly 4. The clamp 22 is nearly circular in shape. Attached to the clamp 22 of the male grip 20 is a base 24, to which a locking strip 26 is attached. A plurality of teeth 28 are attached to the locking strip 26.

The female grip 30 comprises a clamp 32 which is attached to the cord 14 of the female plug assembly 12. The clamp 32 is nearly circular in shape. Attached to the clamp 32 of the female grip 30 is a base 34, in which an insert 36 is located. The insert 36 is designed to receive the locking strip 26.

Although the cross-sectional shape of the insert 36 and the locking strip 26 can vary, they must match one another in order to allow the insert 36 to successfully receive the locking strip 26. Therefore, the preferable cross-sectional shape for both the insert 36 and the locking strip 26 is that of a U-shape.

Once the locking strip 26 is inserted through the insert 36, a locking tab 38 interacts with the plurality of teeth 28 on the locking strip 26 and prevents easy removal of the locking strip 26 from the insert 36. The locking strip 26 cannot merely be pulled out and thus, will not slip out of the insert 36. However, the insert 36 also has an attached release tab 40 which is located adjacent to the locking tab 38. By grasping the release tab 40 and pulling upward, the locking tab 38 will disassociate with the plurality of teeth 28 on the locking strip 26, and thus, allow the locking strip 26 to be removed from the insert 36.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A plug connection device in combination with a male plug assembly and a female plug assembly, the plug connection device comprising:

(a) a male grip attached to the male plug assembly, said male plug assembly further comprising:
a first cord, and
a first head attached to the first cord, and
a plurality of prongs attached to the first head, wherein the male grip further comprises:
a first clamp, the first clamp being attached to the first cord, and
a first base attached to the first clamp, (b) a female grip attached to the female plug assembly, said female plug assembly further comprising:
a second cord,
a second head attached to the second cord,
a plurality of inserts located within the second head,
wherein each of the prongs can be inserted into an insert of the plurality of inserts, and
wherein the female grip further comprises:
a second clamp, the second clamp being attached to the second cord, and
a second base attached to the second clamp, (c) means for connecting the male grip to the female grip, further comprising:
a locking strip attached to the first base,
a plurality of teeth attached to the locking strip,
an insert attached to the second base,
a locking tab attached to the insert,
wherein the locking strip is inserted through the insert, and
further wherein the locking tab interacts with the plurality of teeth on the locking strip, preventing the locking strip from merely being pulled out without additional action, and (d) means for releasing the male grip from the female grip, further comprising:
a release tab attached to the insert adjacent to the locking tab,
wherein grasping the release tab and pulling upward causes the locking tab to disassociate with the plurality of teeth on the locking strip, thereby allowing the locking tab to be removed from the insert,
wherein the locking strip and the insert have the same U-shaped cross-sectional shape.

* * * * *